US007404590B2

(12) United States Patent
Loranger

(10) Patent No.: US 7,404,590 B2
(45) Date of Patent: Jul. 29, 2008

(54) COLLAPSIBLE SHELTER APPARATUS

(76) Inventor: Fabien Loranger, 8110 - 97 Avenue, Fort Saskatchewan, Alberta (CA) T8L 3G6

( * ) Notice: Subject to any disclaimer, the term of this patent is extended or adjusted under 35 U.S.C. 154(b) by 881 days.

(21) Appl. No.: 10/707,850

(22) Filed: Jan. 16, 2004

(65) Prior Publication Data

US 2005/0076584 A1 Apr. 14, 2005

(30) Foreign Application Priority Data

Oct. 10, 2003 (CA) ..... 2445008

(51) Int. Cl.
*B60P 3/34* (2006.01)

(52) U.S. Cl. ..... 296/159; 296/165

(58) Field of Classification Search ..... 296/156, 296/159, 164, 165, 174
See application file for complete search history.

(56) References Cited

U.S. PATENT DOCUMENTS

| | | | | | |
|---|---|---|---|---|---|
| 1,477,111 | A * | 12/1923 | Eaton | 296/174 |
| 3,175,857 | A | 3/1965 | Lewis | 296/23 |
| 3,367,347 | A | 2/1968 | Smith | 135/1 |
| 3,466,082 | A | 9/1969 | Branch | 296/23 |
| 3,737,190 | A | 6/1973 | Smith et al. | 296/23 |
| 4,088,363 | A * | 5/1978 | Palmer | 296/161 |
| 4,294,484 | A * | 10/1981 | Robertson | 296/156 |
| 4,332,265 | A | 6/1982 | Baker | 135/3 A |
| 4,566,729 | A | 1/1986 | Magnino | 296/159 |
| D297,424 | S | 8/1988 | Norris, III | D12/156 |
| 5,299,849 | A | 4/1994 | Cook et al. | 296/100 |
| 5,988,195 | A | 11/1999 | Kaestner et al. | 135/144 |
| 6,604,777 | B2 * | 8/2003 | Neville | 296/164 |
| 6,663,167 | B2 * | 12/2003 | Phillips et al. | 296/165 |
| 6,932,418 | B1 * | 8/2005 | Connell | 296/161 |
| 2002/0163221 | A1 | 11/2002 | Smith | 296/164 |

FOREIGN PATENT DOCUMENTS

| | | |
|---|---|---|
| CA | 233065 | 7/1923 |

* cited by examiner

*Primary Examiner*—Dennis H Pedder
(74) *Attorney, Agent, or Firm*—Bennett Jones LLP

(57) ABSTRACT

The present invention discloses a collapsible shelter to be used in conventional truck beds. The shelter is comprised of a horizontal base that straddles the truck bed and a frame that pivots about an axis that is perpendicular to the longitudinal axis of the truck bed. The frame is comprised of a rear A-shaped frame, a front support post and a ridge pole. The apparatus has bunks slidably, or hingedly, attached to the base that move from a first position on top of the base to a second position whereby they extend horizontally out and away from the side walls of the truck. Angled support members support the bunks in their horizontal position. A shell stretches over the frame and around the bunks. Quick erection of the shelter is facilitated by the pivoting frame.

12 Claims, 15 Drawing Sheets

COLLAPSIBLE SHELTER APPARATUS

CROSS REFERENCE TO RELATED APPLICATIONS

This application claims the priority benefit of Canadian Patent Application 2,445,008 filed on Oct. 10, 2003 entitled "Collapsible Shelter Apparatus", the contents of which are incorporated herein by reference.

BACKGROUND OF INVENTION

The present invention relates to a collapsible shelter apparatus for use in a truck bed.

Pick up trucks are increasingly being used for a variety of outdoor activities including camping. As such there is a need for shelters that can be mounted in, or upon the back of pick up trucks that enables the occupants to sleep comfortably while being sheltered from the weather and the exterior environment. A number of such shelters have been developed. Most common are variations of a hard-bodied camper with a fiberglass or aluminum shell that is bolted or chained to the truck bed. Such hard-bodied campers are complex and expensive, and heavy making removal and storage inconvenient. These hard-bodied campers also remove the ability for any form of cargo storage in the truck bed. Another common form of shelter involves a fixed fiberglass or aluminum roof over the sidewalls of the truck bed. These forms of shelter are heavy and are difficult to remove and they limit the sleeping space to the width and length of the truck bed.

Other forms of collapsible shelter have been developed, some of which employ the use of a central frame with a canvas or fabric cover. However, such shelters generally offer limited sleeping space, are complex and awkward to raise, and are difficult to remove and store when not in use.

There is need in the art for a lightweight collapsible shelter that is economical to produce, that is easy and convenient to erect, that offers generous sleeping space, and which is easy to install and remove when it is not being used.

SUMMARY OF INVENTION

The present invention relates to a collapsible shelter apparatus for use in a truck bed.

In one aspect of the invention, the apparatus comprises a collapsible shelter for mounting in the bed of truck, the truck bed having a floor, a front end and a rear end and at least two side walls substantially parallel to a longitudinal axis, the collapsible shelter comprising:

(a) a substantially horizontal base releasably attached to the truck bed, raised above the truck bed floor;

(b) at least one bunk attached to the base, the bunk being movable between a first position whereby the bunk rests on top of the base in the truck bed, and a second position whereby the bunk extends horizontally out and away from one of the side walls of the truck bed;

(c) a frame having front and rear support members and a ridge pole being releasably connected at one end to the front support member and releasably connected at a second end to the rear support member, the front support member being pivotally attached to the front of the truck bed and the rear support member being pivotally attached to the rear of the truck bed, such that each of the front and rear support members pivot about an axis substantially perpendicular to the longitudinal axis of the truck bed to move between a first collapsed position and a second erect position; and (d) a fabric shell releasably attached to the frame and to the bunk.

In one embodiment, the base rests upon at least one cross beam that is releasably attached to an interior surface of each of the side walls of the truck bed. In one embodiment the bunk has at least one support member that releasably engages the truck frame for supporting at least one bunk in its second position. In another embodiment at least one bunk may have a tension bar to stretch the canvas around the bunk and a slide arm to secure the tension bar in a substantially vertical position. In one embodiment the bunk is hingedly attached to the base, and in a further embodiment, the bunk is slidably attached to the base.

In one embodiment, the apparatus may have a first bunk and a second bunk, the second bunk resting on top of the first bunk when in its first position. In an embodiment of the present invention the rear support member is comprised of a rear A-shaped frame, and the front support member is comprised of a front support post, the rear A-shaped frame and the front support post pivoting about an axis that is substantially perpendicular to the longitudinal axis of the truck bed. In one embodiment the apparatus has a locking means to secure the frame in its erect position. In one embodiment the rear A-shaped frame attaches to a bracket pivotally mounted on the floor of the truck bed, and in another embodiment, the rear A-shaped frame is pivotally mounted to, and releasably engages the rear tailgate mounting assembly. In a further embodiment the rear A-shaped frame has a horizontal platform extending out and away from the back of the truck. In another embodiment the apparatus further comprises a means for suspending objects under the bunk when in its second position.

BRIEF DESCRIPTION OF DRAWINGS

The invention will now be described by means of an exemplary embodiment as shown in the accompanying, simplified, diagrammatic not to scale drawings. In the drawings.

DETAILED DESCRIPTION

The apparatus will now be described having regard to the Figures. For the purposes of this patent application, the following words shall have the following meaning:

(a) "truck bed" means the cargo bed of a truck such as a conventional pick up truck having at least two side walls parallel to a longitudinal axis and having a floor and a rear latchable unfolding door.

(b) "bunk" means a planar structure that can be positioned and secured in a substantially horizontal orientation and which may support goods or people.

Figure 2:
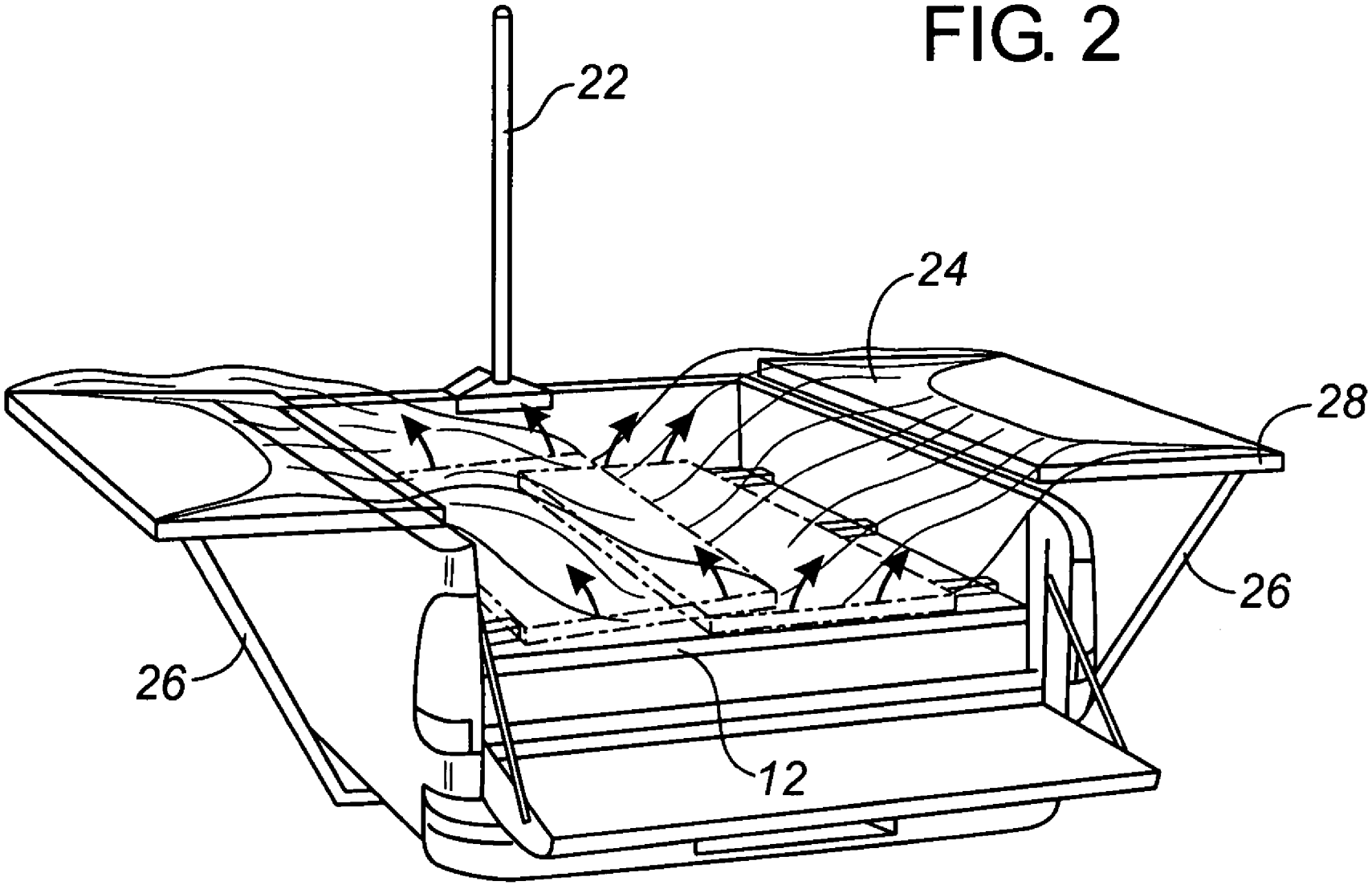
FIG. 2 is a diagrammatic depiction of one embodiment of the apparatus partially erected.
Figure 8:
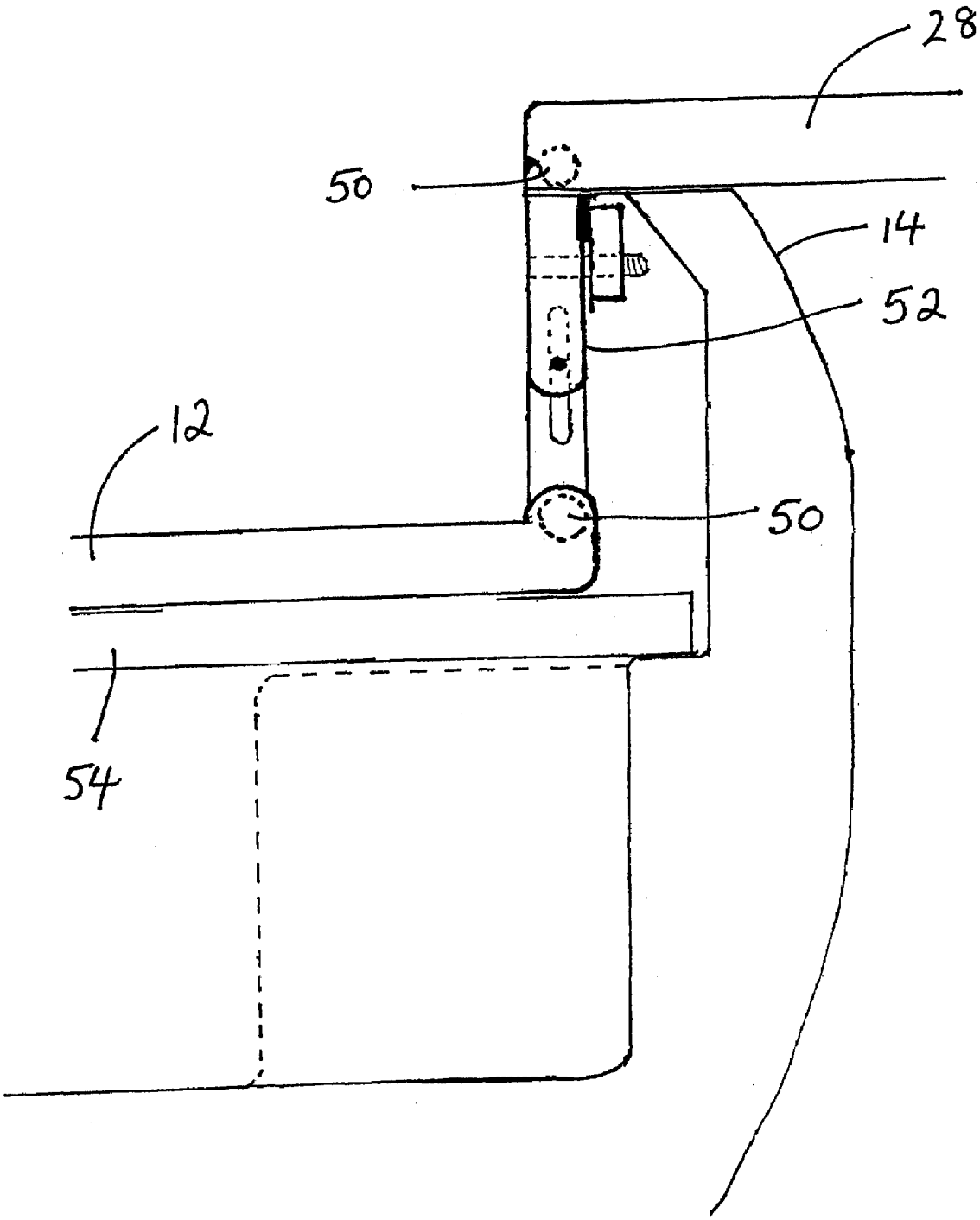
FIG. 8 depicts a rear view of one embodiment of the apparatus showing the base and a hinged bunk connection.
Figure 9:
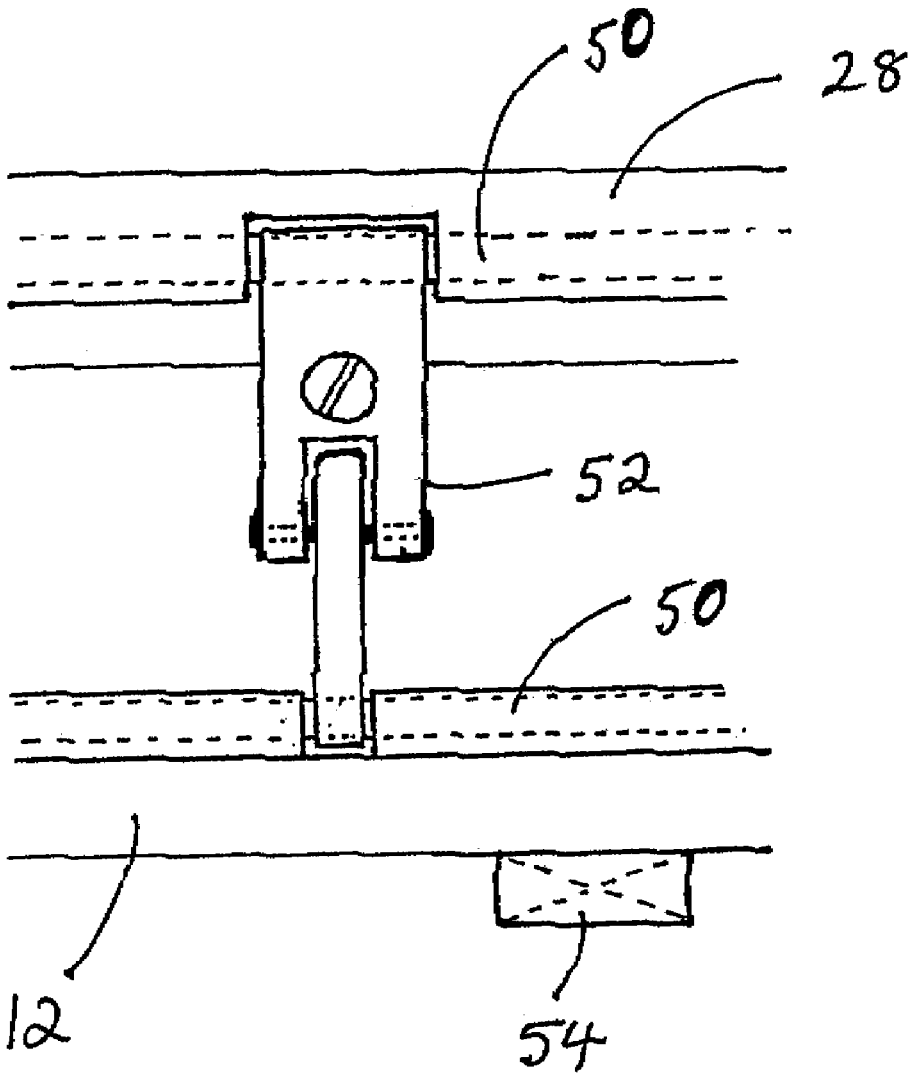
FIG. 9 depicts a side view of one embodiment of the apparatus showing the base and a hinged bunk connection.

As shown in FIG. 2, in one embodiment the shelter (10) has a substantially horizontal base (12) that rests upon two beams (54) which releasably engages the interior surface of the sidewalls (14) of the truck bed. As depicted in FIGS. 8 and 9, in one embodiment, the base (12) may rest upon at least two beams (54) that span the truck bed in an orientation perpendicular to its longitudinal axis. The beams (54) should preferably be light-weight and strong and may be constructed from any suitable materials including, but not limited to, aluminum or wood. The ends of the beams (54) may rest upon recesses in the truck bed sidewalls (14), or alternatively, the base (12) may rest upon brackets or bolts affixed to the interior surface of the sidewalls (14). It should be understood that other releasable engagement means commonly utilized in the art may be used. The releasable nature of the base (12) and beams (54) to truck bed sidewalls (14) facilitates easy insertion and removal of the shelter (10) by the user. The user may lie down on the base (12) when the shelter (10) is raised and a mattress or other padding means may be placed on the base (12) and may be left on during in transit or storage. Luggage or other like objects may be stowed in the space between the base (12) and the floor of the truck be the interior surface of the sidewalls (14) of the truck bed.

Figure 1:
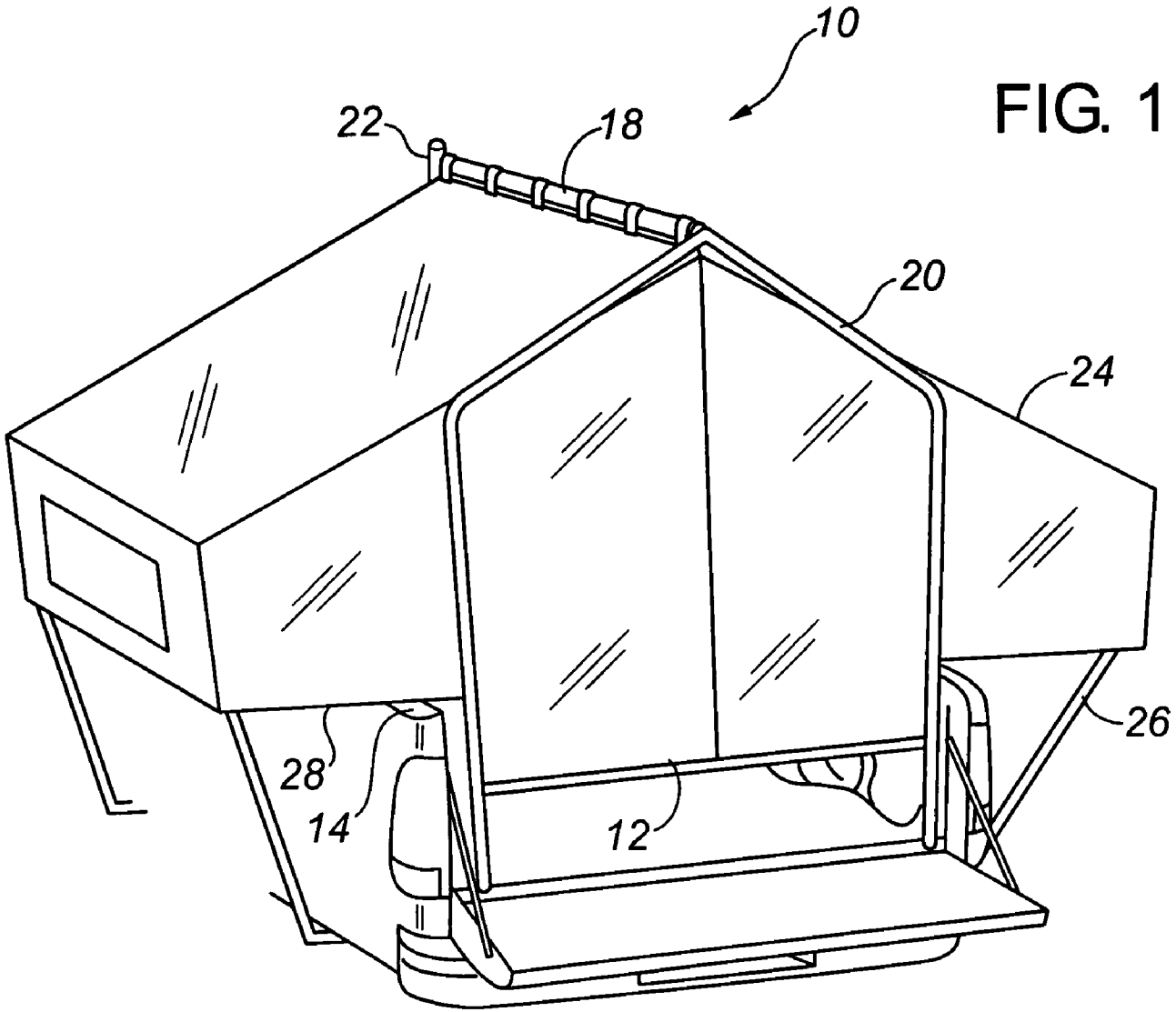
FIG. 1 is a diagrammatic depiction of one embodiment of the apparatus when erect.

As shown in FIGS. 1 and 2, the shelter (10) has at least one bunk (28) movable between a first position in which it rests upon the top surface of the base (12) in the truck bed, and a second position in which it extends out and away from one of the side walls (14) of the truck in a substantially horizontal orientation, thereby increasing the available sleeping space. In one embodiment the bunk (28) may be hingedly attached to the base (12) or the side wall (14) such that it unfolds from its first position to its second position. As shown in FIGS. 8 and 9, the hinge attachment may be comprised of tubular supports (50) mounted on the bunk (28) and base (12) and a pivoting panel arm (52) that is connected at each end to the tubular supports (50) on the bunk (28) and the base (12).

Figure 4:
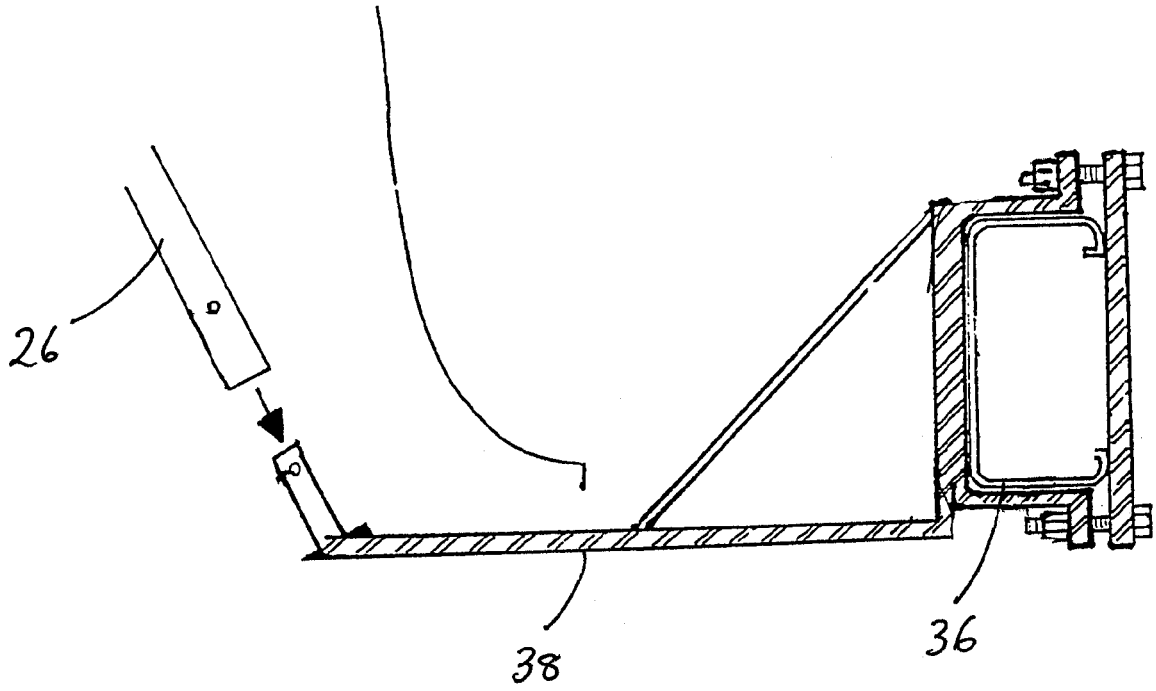
FIG. 4 depicts a cross sectional rear view of one embodiment of the apparatus showing the structural support and truck frame.
Figure 5:
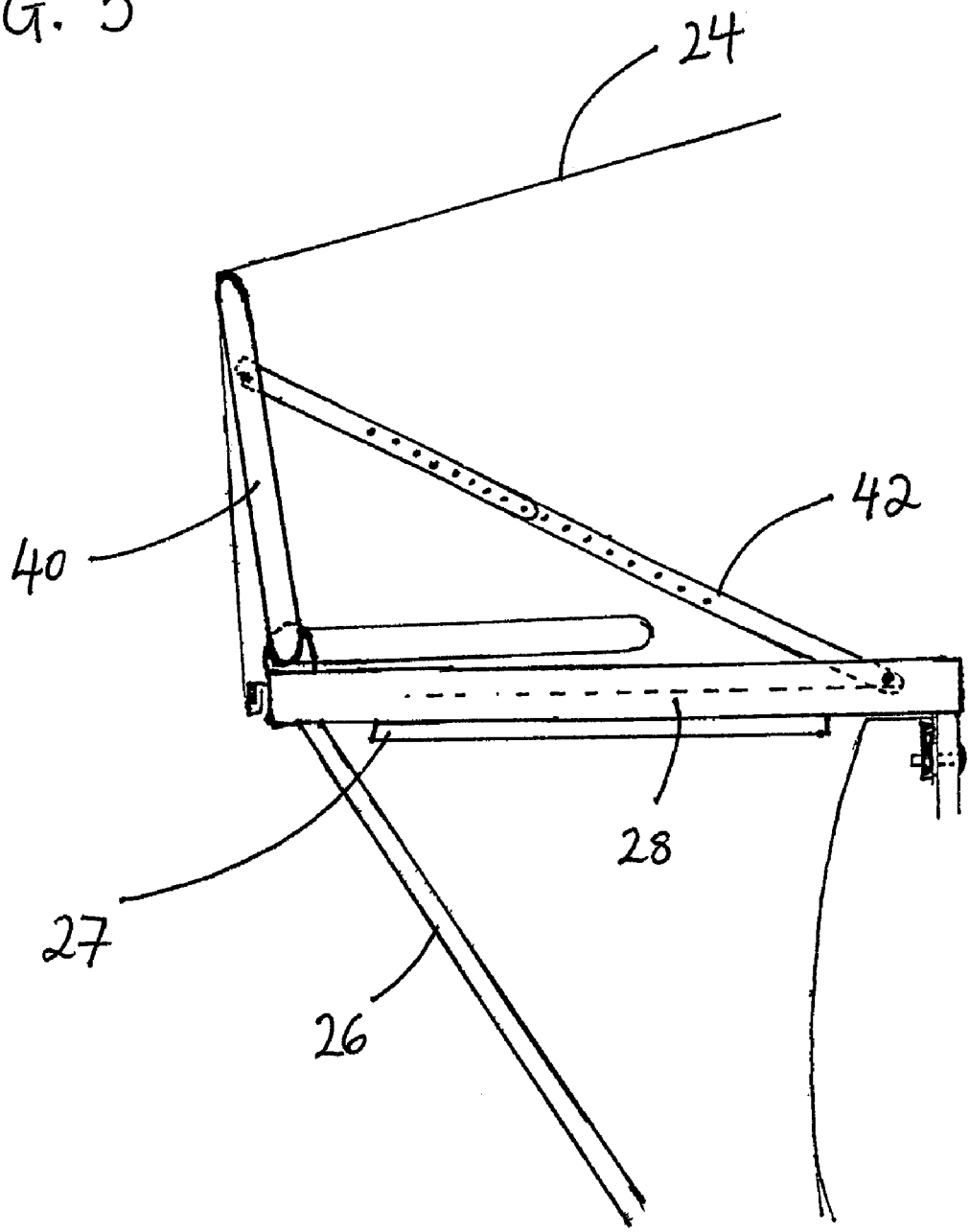
FIG. 5 depicts a cross sectional rear view of one embodiment of the apparatus showing a bunk in its second position.
Figure 6:
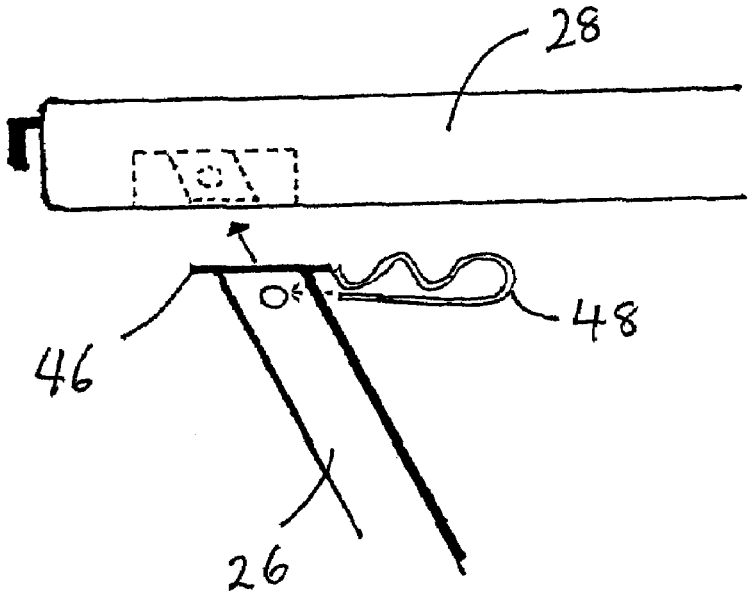
FIG. 6 depicts cross sectional rear view of one embodiment of the apparatus showing a support member and a bunk.
Figure 7:
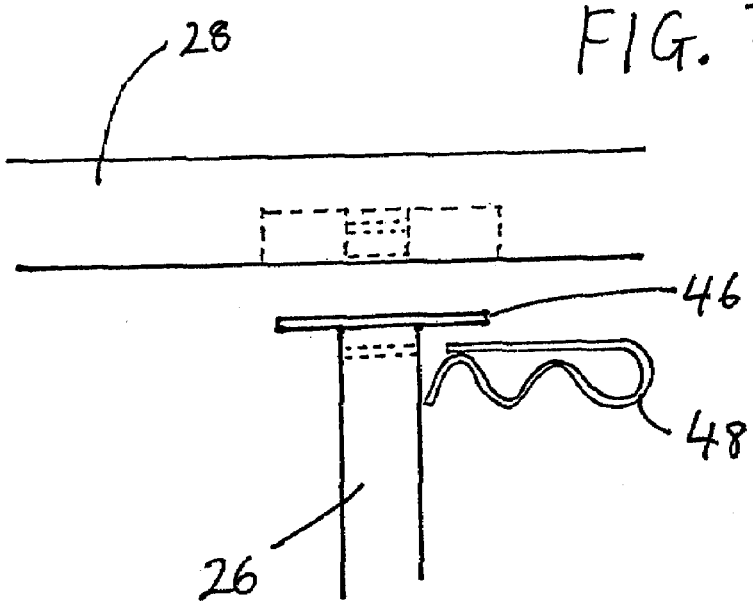
FIG. 7 depicts a cross sectional side view of one embodiment of the apparatus showing a support member and a bunk.

As depicted in FIGS. 1, 2 and 5, the bunk (28) may have associated support members (26) that are pivotally attached to the surface of the bunk (28) that faces the ground when the bunk (28) is in its second position in an area proximate to the edge of the bunk (28) furthest from the sidewall (14) of the truck bed. In an alternate embodiment, the support members (26) are detachable from the bunk (28) and are engaged to the bunk surface once the bunk (28) is in its second position as shown in FIGS. 6 and 7. Any suitable attachment means may be used for attaching the support members (26) to the bunk (28) and may include the use of a cotter pin (48) as shown in FIGS. 6 and 7. As depicted in FIGS. 6 and 7, the support members (26) may have flat weight distribution plates (46) at the end that engages the bunk (28). As illustrated by FIGS. 1, 4 and 5, in one embodiment the support member (26) releasably engages the frame of the truck (36) thereby providing the necessary support to hold the bunk (28) in a substantially horizontal orientation. As shown in FIG. 4, in one embodiment structural supports (38) may be affixed to the truck frame (36), the structural supports (38) being configured to extend outwards from the truck frame (36) and to releasably engage the support members (26). When the bunk (28) is in its first position in the truck bed, the support members (26) pivot to lie flat on top of the bunk (28), or alternatively they can be removed if they detachably engage the bunk (28).

As depicted in FIG. 5, the bunk (28) may have a tension bar (40) pivotally attached to the surface of the bunk (28) that faces upwards when it is in its second position in an area proximate to the edge of the bunk (28) furthest from the truck bed. The tension bar (40) stretches the canvas shell (24) over and around the bunk (28) creating space for the occupants and creating the sidewalls of the shelter (10). During transport and storage, the tension bar (40) lays flat on top of the bunk (28) and during use of the shelter (10), the tension bar (40) is pivoted to substantially vertical position as shown in FIG. 5. Alternatively, the tension bar (40) may be removed from the bunk (28) during storage and reattached during set-up of the shelter (10). Attachment means for the tension bar (40) may include a thread and wing nut configuration, or such other suitable attachment means that facilitates easy removal and attachment. As also shown in FIG. 5, the bunk (28) may also have a retractable slide arm (42), or slide arms, that engage the tension bar (40) and that secure the tension bar (40) in its vertical position. The slide arms (42) may be pivotally attached to the sides of the bunk (28) that face the front of the truck and the rear of the truck when the bunk (28) is in its second position, such that the slide arms (42) can be moved to a inactive storage position that is substantially parallel to the sides of the bunk (28) as shown in FIG. 5. The slide arm (42) and the tension bar (40) may be constructed from preformed aluminum, or from such other suitable materials as are commonly used in the art. The bunk (28) itself must be light but strong enough to support the weight of one or two occupants and may constructed from wood or reinforced plastic, or from such other suitable materials as are commonly used in the art.

As shown in FIG. 5, in one embodiment of the present invention, the surface of the bunk (28) that faces the ground when in its second position may have a means for suspending objects (27) such as coolers or bags. The suspension means may be comprised of T bars and corresponding tracks, brackets or hooks, or such other suitable suspension means as are commonly used in the art.

As depicted in FIGS. 1 and 2, the shelter (10) may have two bunks to increase sleeping space. In one embodiment, the second bunk may be a mirror image of the first bunk being attached to the opposite side of the base that the first bunk is attached to. During storage or transportation, the second bunk rests on top of the first bunk on top of the base (12) in the truck bed. The bunks are then unfolded from the base sequentially during set-up.

Figure 16:
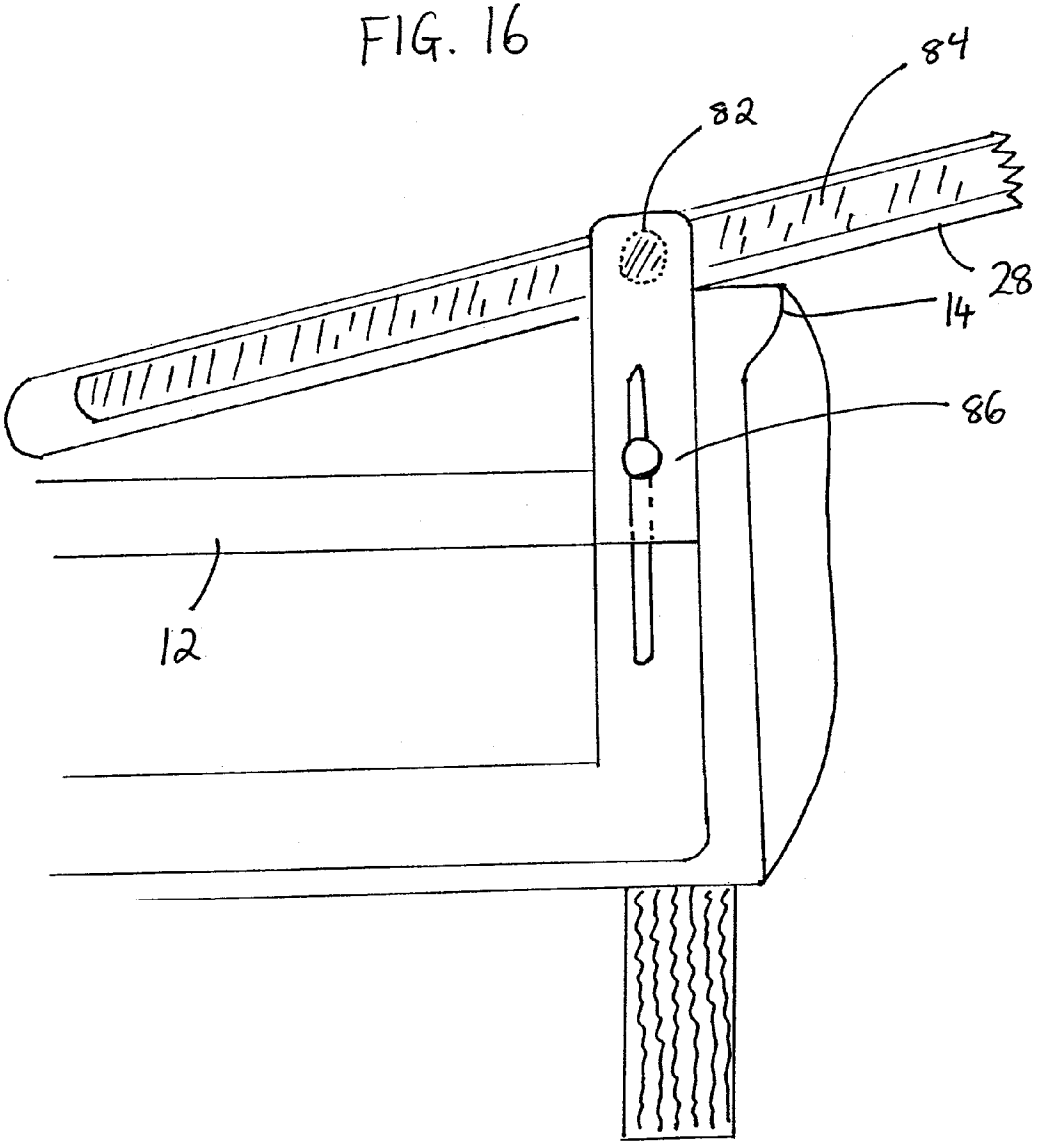
FIG. 16 depicts a rear view of one embodiment of the apparatus showing a track and slide wheel attachment system for a bunk.

In an alternate embodiment as shown in FIG. 16, the bunks (28) may be slidably attached to the base (12) by suitable attachment means, including without limitation, a slide wheel and guide track system or a T bar and corresponding guide track system. FIG. 16 depicts an embodiment of the present invention that utilizes a slide wheel (82) and guide track (84) system. The guide tracks (84) run along the sides of the bunk (28) that face the front and the rear of the truck bed and the slide wheels (82) are mounted on slide bars (86) extending vertically from the base (12) in the truck bed at the rear and front of the truck bed. The slide bars (86) may be raised and lowered to facilitate storage of the bunk (28) in a substantially horizontal position on top of the base (12). To move the bunk (28) to its second active position, the user raises the slide bars (86) until the slide wheels (82) are parallel with the top of the sidewall (14). The user then grasps the edge of the bunk (28) and pulls it out and away from the side of the truck. The guide tracks (84) move over the slide wheels (84) until the bunk (28) reaches its second extended position. The bunk (28) is then secured in a horizontal orientation using the support members (26). The slide mechanism may also have a locking means to secure the bunk (28) in its second position thereby preventing the bunk (28) from sliding back into the truck bed. To store the bunk (28), the support members (26) are disengaged from the bunk (28), the locking mechanism is disengaged and the bunk (28) is pushed back towards the truck bed. The bunk (28) slides into the truck bed and the slide bar (86) is then lowered such that the bunk (28) may rest in a substantially horizontal position on the base (12). Two bunks may also be used with this attachment configuration by having slide arms (86) on opposite sides of the longitudinal axis of the truck bed. As with the hinged connection system, the second bunk rests on top of the first bunk on top of the base (12) during storage or transportation.

Figure 3:
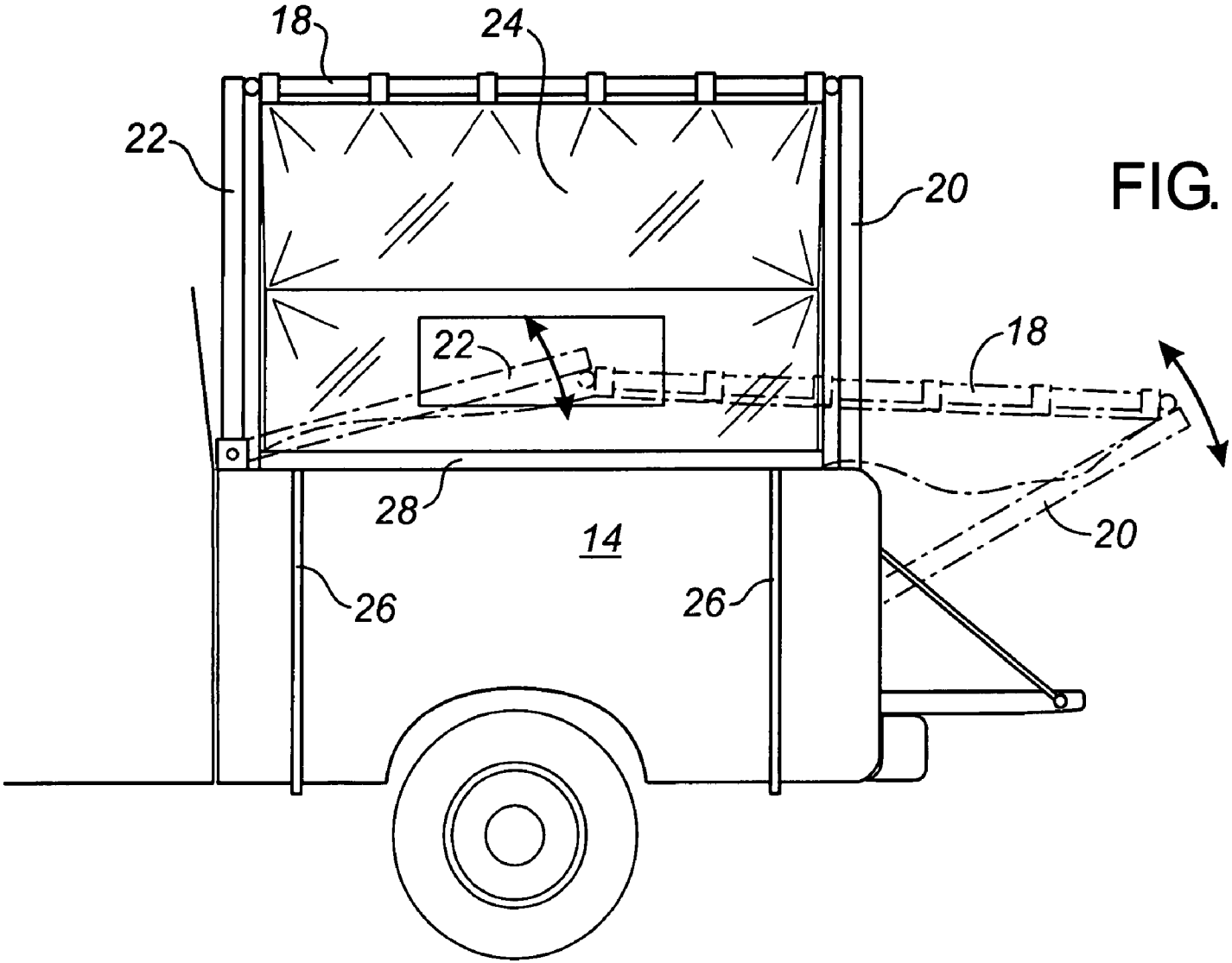
FIG. 3 is a diagrammatic depiction of a side view one embodiment of the apparatus showing its movement from a collapsed state to its final erect state.

As shown in FIGS. 1, 2 and 3, the shelter (10) has a frame having front (22) and rear (20) support members, respectively pivotally attached to the front and rear of the truck bed respectively such that the front (22) and rear support members (20) pivot about an axis substantially perpendicular to the longitudinal axis of the truck bed. The frame is moveable between a first collapsed position in which the frame lies substantially flat in the truck bed and a second erect position as shown in FIG. 3.

Figure 10:
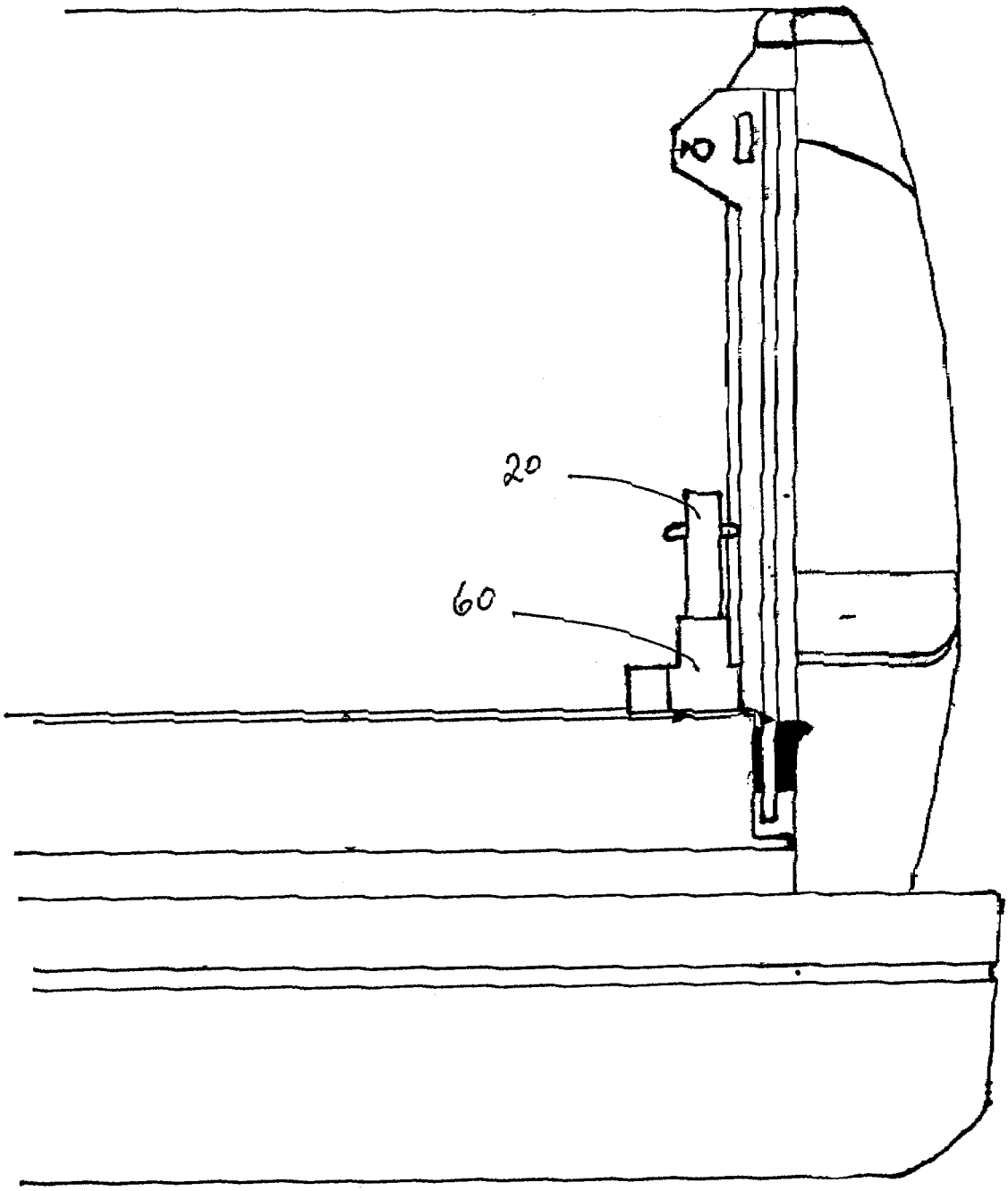
FIG. 10 depicts a rear view of one embodiment of the apparatus showing the rear support member bracket.
Figure 11:
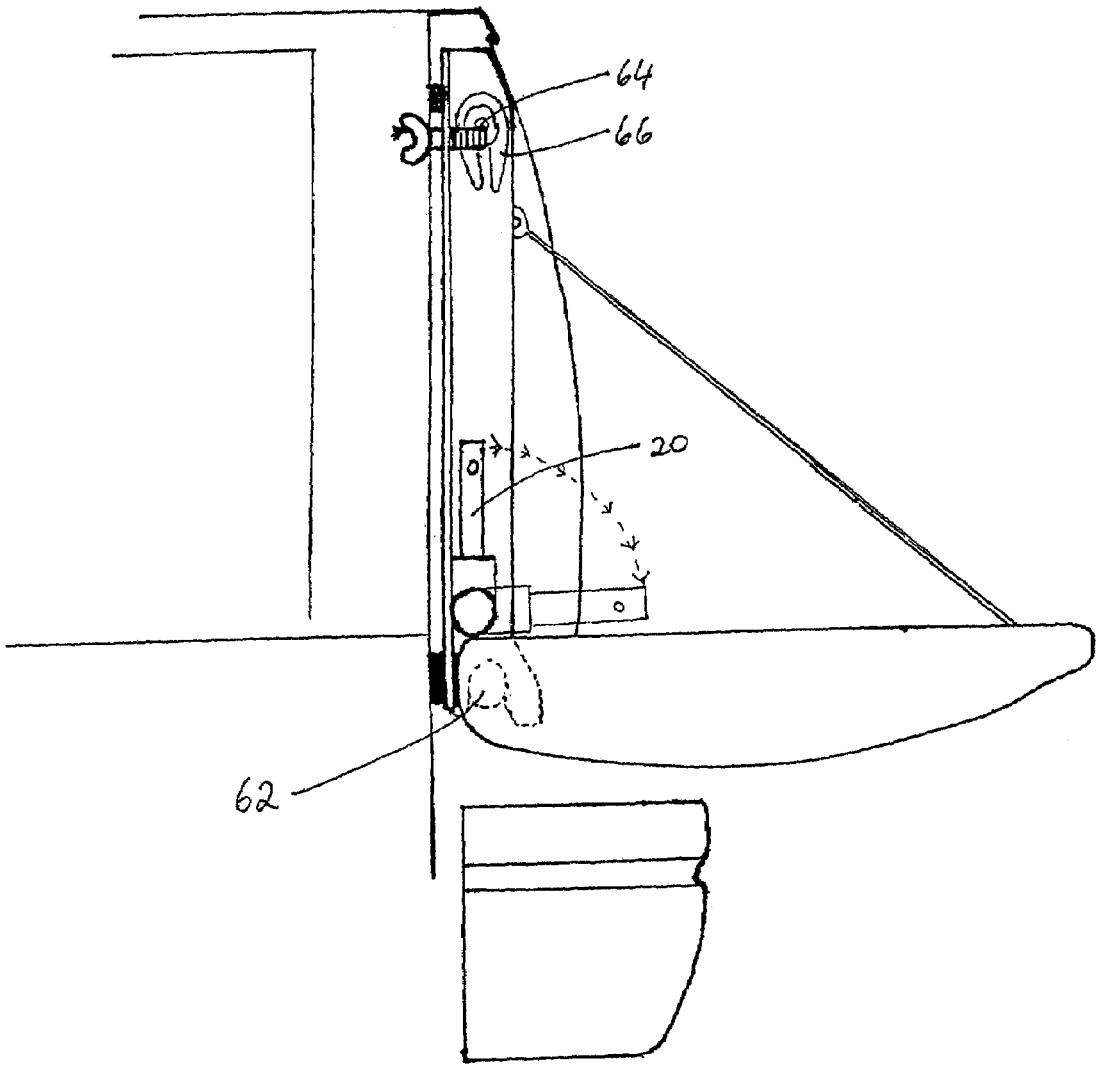
FIG. 11 depicts side view of one embodiment of the apparatus showing the rear A-shaped frame mounted on the rear tailgate support pins.
Figure 13:
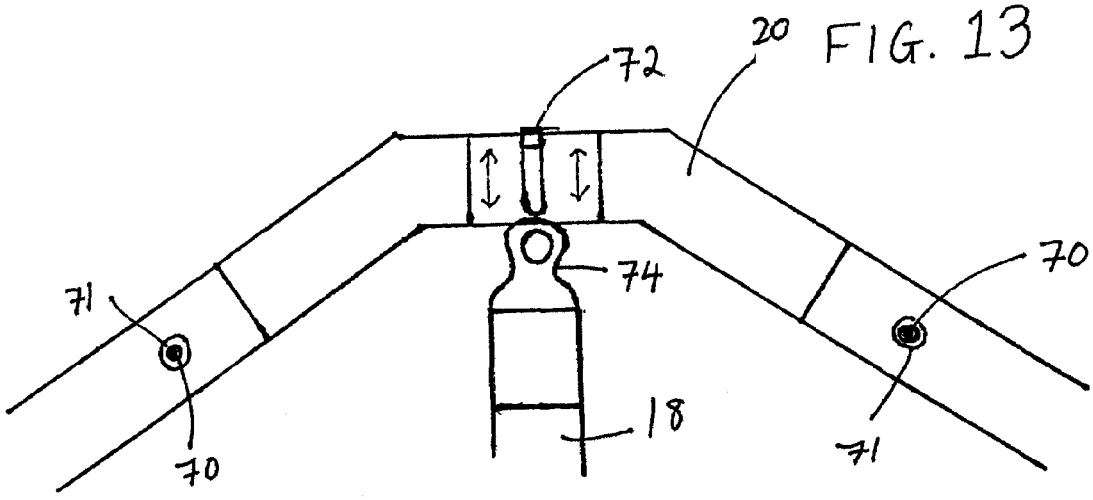
FIG. 13 depicts a front view of one embodiment of the apparatus showing the connection between the ridge pole and the rear A-shaped frame.

In one embodiment, the rear support member (20) is an A-shaped frame pivotally attached to the rear of the truck bed. To facilitate easy storage, the rear A-shaped frame (20) may be comprised of a plurality of pieces that connect by means of spring loaded connect pins (70) that engage corresponding holes (71) in the frame pieces as shown in FIG. 13. The rear A-shaped frame (20) may be attached to brackets (60) mounted on the floor of the truck bed as shown in FIG. 10, or alternatively, it may be pivotally mounted on the rear tailgate support pins of the truck (62) as shown in FIG. 11. When the rear A-shaped frame (20) is pivotally mounted on the rear tailgate support pins of the truck (62) as shown in FIG. 11, the rear A-shaped frame (20) may be configured such that it can be mounted to the rear tailgate support pins (62) with or without the removal of the tailgate. A locking means may be utilized to lock the rear A-shaped frame (20) into its vertical position. The locking means may be comprised of a locking ring (66) that engages the rear A-shaped frame (20) with the tailgate locking pins of the truck (64) as also shown in FIG. 11.

Figure 17:
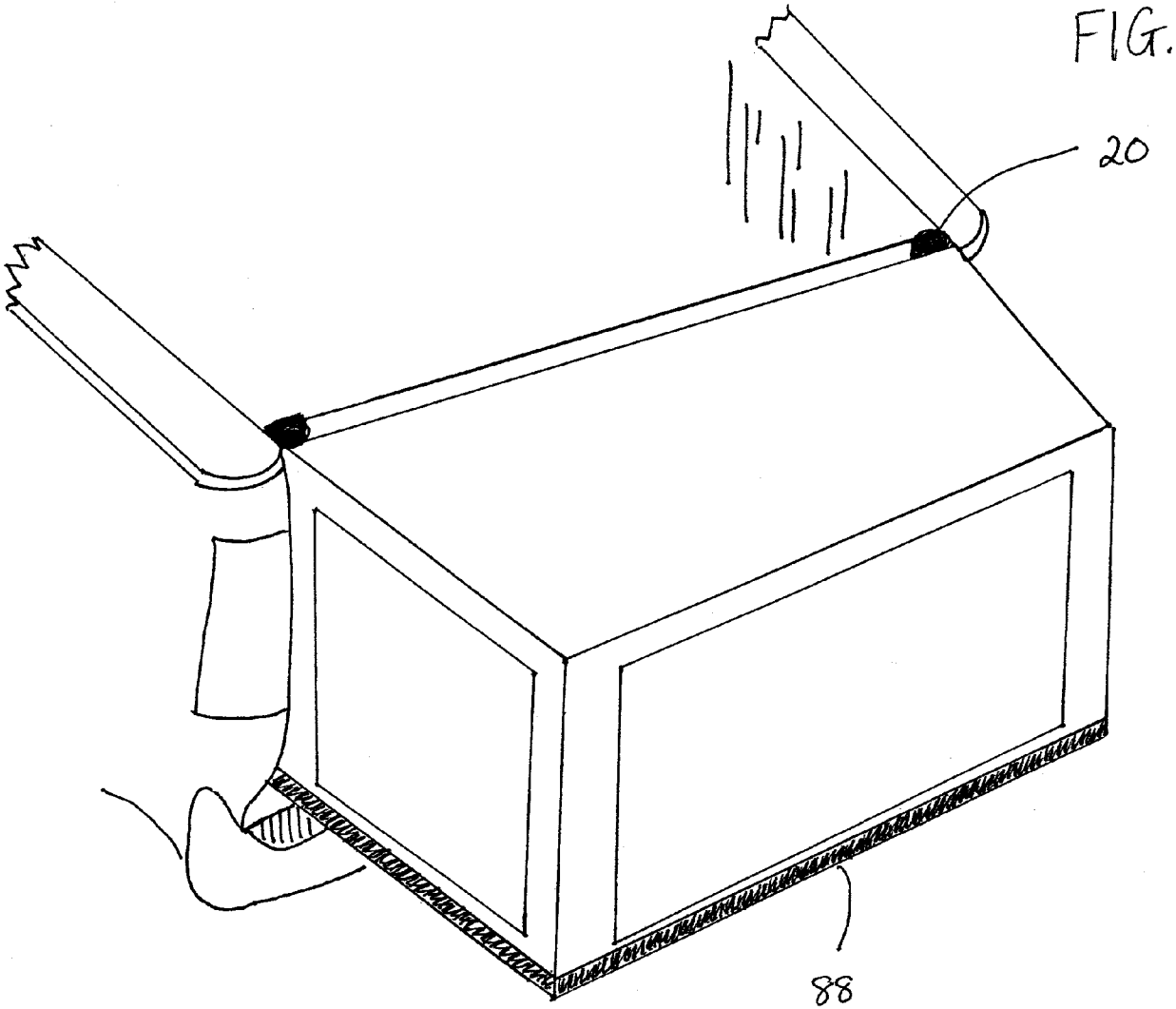
FIG. 17 depicts a rear view of one embodiment of the apparatus showing the rear A-shaped frame with a platform.

In another embodiment, the rear A-shaped frame (20) may have latches that releasably engage the tailgate locking pins (64), however, any suitable locking means may be employed to secure the rear A-shaped frame (20) in its erect position. As shown in FIG. 17, in a further embodiment the rear A-shaped frame (20) may also have a horizontal platform (88) extending out and away from the rear of the truck. The tailgate can be removed to facilitate the extension of the platform (88) or alternatively, the platform (88) may rest on top of the open tailgate. The platform (88) may be configured to store large objects such as coolers during transportation, or it may be configured to form additional storage space as shown in FIG. 17. Once the shelter (10) has been erected, the items stored on the platform (88) may be stored under the bunks (28) using the suspension means (27) described above. Alternatively, the platform (88) may be configured to store steps (not shown) that can be unfolded and used to access the truck bed when the shelter (10) is erected.

Figure 14:
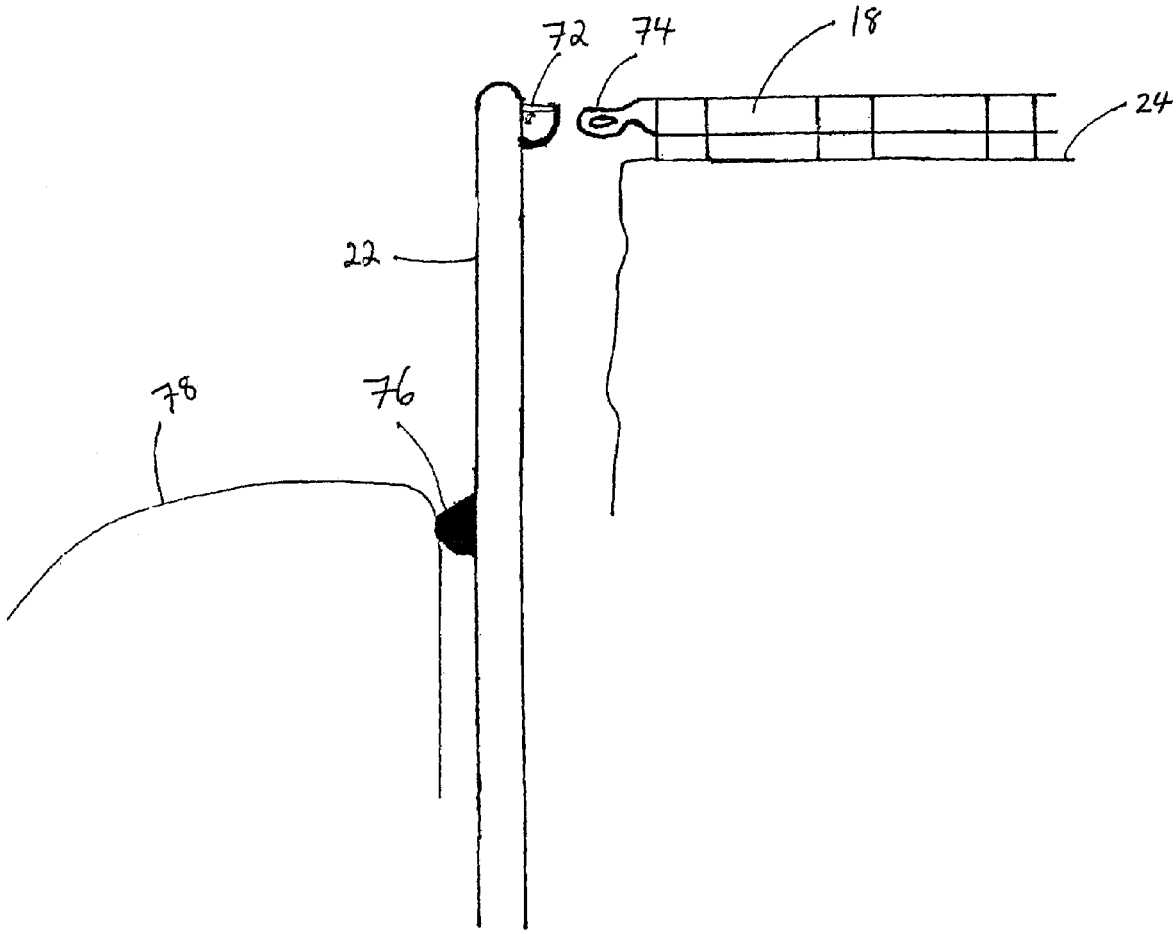
FIG. 14 depicts a side view of one embodiment of the apparatus showing the connection between the ridge pole and the front support post.
Figure 15:
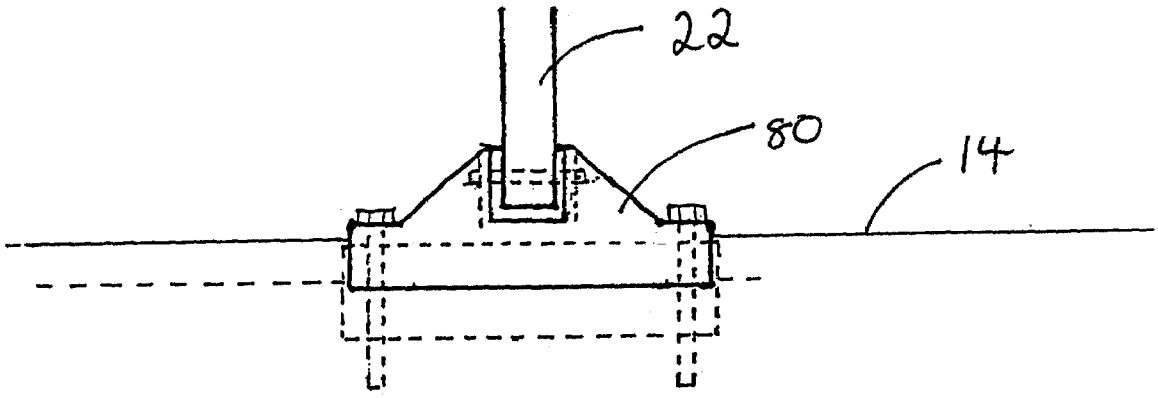
FIG. 15 depicts a front view depicts a side view of one embodiment of the apparatus showing the support bracket for the front support post.

As depicted in FIG. 15, the front support member (22) may be a support post pivotally attached to the front of the truck bed by means of a support bracket (80). The support member (80) may be affixed to the floor of the truck bed, or to the top of the front side wall (14) as shown in FIG. 15. To facilitate easy storage, the front support post (22) may be comprised of a plurality of pieces that connect by means of spring loaded connect pins (70) that engage corresponding holes (71) in the frame pieces. As depicted in FIG. 14, a rubber or plastic stopper (76) may be mounted on the truck cab to provide resistance to the front support post (22) when in its vertical position and to prevent the front support post (22) from damaging the cab (78) of the truck.

Figure 12:
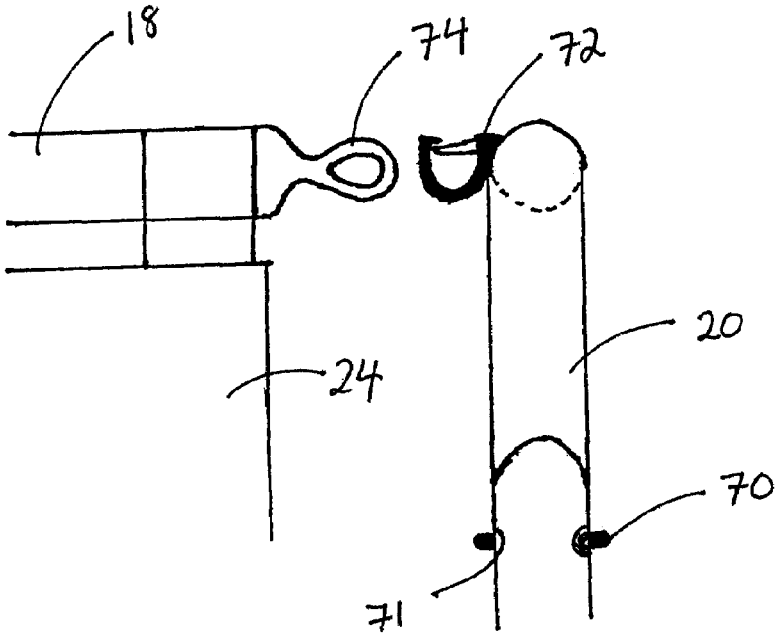
FIG. 12 depicts a side view of one embodiment of the apparatus showing the connection between the ridge pole and the rear A-shaped frame.

A ridgepole (18) is used to connect the rear A-shaped frame (20) and the front support post (22). The ridgepole (18) releasably engages the rear A-shaped frame (20) and the front support post (22) to facilitate easy assembly and disassembly of the shelter (10). The engagement means must also facilitate the movement of the frame from its first collapsed position to its second erect position. As shown in FIGS. 12, 13 and 14, hooks with spring loaded locking arms (72) and connector rings (74) may be used for the attachment means, however such suggestion is not intended to be limiting of the invention claimed herein, and such other suitable engagement means as are commonly used in the art may also be utilized. The frame may be made from preformed aluminum, carbon, graphite or such other suitable materials as may be utilized by one skilled in the art.

A fabric shell (24) stretches over the frame and attaches to the edges of the bunk (28) to provide shelter for the occupants. As shown in FIGS. 1, 3 and 14 the shell (24) may releasably engage the frame by means of loops through which the ridgepole (18) feeds, however other suitable engagement means may be employed. The shell (24) attaches to the edge of the bunk (28) furthest from the side of the truck using suitable attachment including without limitation complimentary interlocking ridges that may be made from plastic or such other suitable material as is available, or using complimentary snaps. In one embodiment, the rear A-shaped frame (20) and the front support post (20) are able to expand upwards when in their vertical position using adjusting pins and corresponding holes to facilitate the stretching of the shell (24) which may shrink and stretch depending on the weather conditions. As shown in FIG. 1, the shell (24) may have a zippered door and zippered windows. The shell (24) may be made of canvas or some other flexible weather-proof covering material.

Having regard to the embodiment of the invention depicted in the figures and as described above, the assembly of the shelter (10) will now be described.

The first step of the assembly process is to place the rear A-shaped frame (20) into its support brackets (60) or onto the rear tailgate support pins (62), as the case may be. At this stage both the front (22) and rear (20) support members are in the first collapsed position laid flat with the rear support member (20) resting on the truck bed and extending out through the rear of the truck bed, and with the front support member (20) laying on top of the base (12) pointing towards the rear of the truck bed. Next the ridgepole (18) is fed through the loops on the shell (24) and is then attached to the front (22) and rear (20) support members. The frame is then pushed towards the front of the truck causing the front (22) and rear (20) support members to pivot to a substantially vertical position, thereby raising the ridgepole (18) to an elevated position parallel to the floor of the truck bed as shown in FIG. 3. When the front support member (22) engages the stopper (76) on the truck cab, the locking ring (66) is engaged locking the rear support member (20), and by virtue of the connections the rest of the frame as well, in its second erect position.

Next the bunks (28) are unfolded if hingedly attached to the base (12), or slid out if slidably attached to the base (12), from the truck bed from their first position to their second position extending out and away from the side walls (14) of the truck bed. The support members (26) are attached to the truck frame (36) and to the lower surface of the bunks (28) to secure the bunks (28) in their second position. The user then raises the tension bar (40) on the bunks (28) to its vertical position and secures the same in place using the slide arms (42). Finally the shell (24) is stretched over the tension bars (40) and is attached to the edge of the bunks (28) furthest from the truck bed using suitable attachment means.

To collapse the shelter (10), these steps are reversed.

As will be apparent to those skilled in the art, various modifications, adaptations and variations of the foregoing specific disclosure can be made without departing from the scope of the invention claimed herein. The various features and elements of the described invention may be combined in a manner different from the combinations described or claimed herein, without departing from the scope of the invention.

The invention claimed is:

1. A collapsible shelter for mounting in the bed of a truck, the truck bed having a floor, a front end and a rear end and at least two side walls substantially parallel to a longitudinal axis, the collapsible shelter comprising:

(a) a substantially horizontal base releasably attached to the truck bed, raised above the truck bed floor;

(b) at least one bunk attached to the base, the bunk being movable between a first position whereby the bunk rests on top of the base in the truck bed, and a second position whereby the bunk extends horizontally out and away from one of the side walls of the truck bed;

(c) a frame having front and rear support members and a ridge pole being releasably connected at one end to the front support member and releasably connected at a second end to the rear support member, the front support member being pivotally attached to the front of the truck bed and the rear support member being pivotally attached to the rear of the truck bed, such that each of the front and rear support members pivot about an axis substantially perpendicular to the longitudinal axis of the truck bed to move between a first collapsed position and a second erect position, and wherein the truck bed further comprises tailgate support pins and upper tailgate locking pins located at the rear of the truck bed, whereby the rear support member is pivotally mounted to the tailgate support pins and releasably engages the tailgate locking pins to secure the rear support member in its erect position; and (d) a fabric shell releasably attached to the frame and to the bunk.

2. The apparatus of claim 1 wherein the base rests upon at least one cross beam that releasably attaches to an interior surface of each of the side walls of the truck bed.

3. The apparatus of claim 1 wherein at least one bunk further comprises at least one support member that releasably engages the truck for supporting the bunk in its second position.

4. The apparatus of claim 1 wherein at least one bunk further comprises a tension bar pivotally attached to a side edge of the bunk for stretching the shell around the bunk.

5. The apparatus of claim 4 further comprising a slide arm attached to the bunk that releasably engages the tension bar for securing the tension bar in an erect position.

6. The apparatus of claim 1 wherein the bunk is hingedly attached to the base.

7. The apparatus of claim 1 wherein the bunk is slideably attached to the base.

8. The apparatus of claim 1 comprising a first and a second bunk each movable between a first position whereby the second bunk rests on top of the first bunk on top of the base in the truck bed, and a second position whereby the second bunk extends horizontally out and away from the side wall of the truck bed opposite to the side wall that the other bunk extends out from.

9. The apparatus of claim 1 wherein the rear support member comprises a rear A-shaped frame, and wherein the front support member comprises a front support post pivotally attached to the front of the truck bed, the front support post pivoting about an axis substantially perpendicular to the longitudinal axis of the truck bed.

10. The apparatus of claim 9 wherein the rear A-shaped frame attaches pivotally to a bracket fastened to the floor in the rear end of the truck bed.

11. The apparatus of claim 9 wherein the rear A-shaped frame further comprises a substantially horizontal platform extending out and away horizontally from the rear of the truck bed.

12. The apparatus of claim 1 further comprising a means for suspending objects under the bunk when in its second position.

* * * * *